US011078720B2

(12) United States Patent
Kellum

(10) Patent No.: US 11,078,720 B2
(45) Date of Patent: Aug. 3, 2021

(54) CORNER KEY FOR EXTRUDED WINDOWS AND DOORS

(71) Applicant: Amesbury Group, Inc., Amesbury, MA (US)

(72) Inventor: Wilbur J. Kellum, Garretson, SD (US)

(73) Assignee: Amesbury Group, Inc., Edina, MN (US)

( * ) Notice: Subject to any disclaimer, the term of this patent is extended or adjusted under 35 U.S.C. 154(b) by 0 days.

(21) Appl. No.: 16/870,235

(22) Filed: May 8, 2020

(65) Prior Publication Data

US 2020/0355022 A1 Nov. 12, 2020

Related U.S. Application Data

(60) Provisional application No. 62/845,660, filed on May 9, 2019.

(51) Int. Cl.

| | |
|---|---|
| ***E06B 3/96*** | (2006.01) |
| ***E06B 3/964*** | (2006.01) |
| ***E06B 3/968*** | (2006.01) |

(52) U.S. Cl.

CPC ..... *E06B 3/9644* (2013.01); *E06B 3/968* (2013.01)

(58) Field of Classification Search

CPC ..... E06B 3/96; E06B 3/964; E06B 3/9644; E06B 3/9645; E06B 3/968; E06B 3/9681; E06B 3/9682; E06B 3/972; E06B 3/9725

USPC ..... 52/655.1, 656.9, 656.2, 656.4, 656.5

See application file for complete search history.

(56) References Cited

U.S. PATENT DOCUMENTS

| | | | | |
|---|---|---|---|---|
| 1,767,487 | A | 6/1930 | Shogren | |
| 1,852,866 | A | 4/1932 | Weitzel | |
| 2,996,159 | A | 8/1961 | Casebolt | |
| 3,269,455 | A | 8/1966 | Gillotti | |
| 3,294,429 | A | 12/1966 | Halip | |
| 3,294,430 | A | 12/1966 | Halip | |
| 3,485,519 | A * | 12/1969 | Chiu | F16B 12/40 403/172 |
| 3,604,739 | A | 9/1971 | Carlisle | |
| 3,627,359 | A | 12/1971 | Paul | |
| 3,643,989 | A | 2/1972 | Sattler | |

(Continued)

FOREIGN PATENT DOCUMENTS

| | | | |
|---|---|---|---|
| CN | 102434553 A * | 5/2012 | E06B 3/9645 |
| CN | 109025708 A * | 12/2018 | |

(Continued)

OTHER PUBLICATIONS

Machine translation of FR2727167, https://translationportal.epo.org/emtp/translate?ACTION=description-retrieval&COUNTRY=FR&ENGINE=google&FORMAT=docdb&KIND=A1&LOCALE=en_EP&NUMBER=2727167&SRCLANG=fr&TRGLANG=en&apikey=TSMqTfrVAvNtryGI8Qlfbozj8DnAGIqJ&PDF=wQi1PM_zaUQRnKAJOCvGeuR_d-FPdrygUKyrWsXS (Year: 2020).*

(Continued)

*Primary Examiner* — Ryan D Kwiecinski

(57) ABSTRACT

A corner key includes a heel and at least one leg extending from the heel defining a longitudinal axis. A nose is disposed along the longitudinal axis. The nose includes a first wedge area and an opposite second wedge area. The corner key further includes a bridge connecting the nose to the at least one leg. Upon insertion into a frame member, the nose substantially rotates to engage both the first wedge area and the second wedge area within the frame member and wedge the nose therein.

17 Claims, 10 Drawing Sheets

(56) References Cited

U.S. PATENT DOCUMENTS

| | | | | |
|---|---|---|---|---|
| 3,709,533 | A | 1/1973 | Walters | |
| 3,782,054 | A * | 1/1974 | Goss, Jr. | E06B 3/9682 403/295 |
| 3,784,043 | A | 1/1974 | Presnick | |
| 3,797,194 | A | 3/1974 | Ekstein | |
| 3,829,226 | A * | 8/1974 | Kreusel | E06B 3/9681 403/295 |
| 3,866,380 | A | 2/1975 | Benson | |
| 3,932,046 | A | 1/1976 | Kawazu | |
| 4,049,355 | A | 9/1977 | Kawazu | |
| 4,090,799 | A | 5/1978 | Crotti | |
| 4,136,470 | A | 1/1979 | Barz | |
| 4,139,316 | A | 2/1979 | Svensson | |
| D252,365 | S | 7/1979 | Durham, III | |
| 4,195,681 | A | 4/1980 | Douglas | |
| 4,240,765 | A | 12/1980 | Offterdinger | |
| 4,296,587 | A | 10/1981 | Berdan | |
| D267,764 | S | 2/1983 | Sundberg | |
| 4,380,110 | A | 4/1983 | Harig | |
| 4,516,341 | A | 5/1985 | Jenkins | |
| 4,531,315 | A | 7/1985 | Sobel | |
| 4,570,406 | A | 2/1986 | DiFazio | |
| 4,636,105 | A | 1/1987 | Johansson | |
| D288,244 | S | 2/1987 | Schmidt | |
| 4,683,634 | A | 8/1987 | Cole | |
| 4,691,486 | A | 9/1987 | Niekrasz | |
| D292,671 | S | 11/1987 | Bjorkman | |
| 4,725,083 | A | 2/1988 | Schauer | |
| D307,078 | S | 4/1990 | Guillemet | |
| D313,170 | S | 12/1990 | Nye | |
| 4,974,352 | A | 12/1990 | Shwu-Jen | |
| 5,010,708 | A | 4/1991 | Evans | |
| D317,400 | S | 6/1991 | Loew | |
| 5,040,456 | A * | 8/1991 | Hayes | B41F 15/36 101/127.1 |
| 5,105,591 | A * | 4/1992 | Leopold | E06B 3/667 52/172 |
| 5,144,780 | A | 9/1992 | Gieling | |
| 5,165,730 | A | 11/1992 | McElroy | |
| 5,271,171 | A | 12/1993 | Smith | |
| D346,278 | S | 4/1994 | Pritchett | |
| 5,378,077 | A | 1/1995 | Paulsen | |
| 5,431,211 | A | 7/1995 | Guillemet | |
| 5,473,853 | A | 12/1995 | Guillemet | |
| 5,547,011 | A | 8/1996 | Dotson | |
| 5,564,758 | A | 10/1996 | Tiberio | |
| D382,714 | S | 8/1997 | Gignac | |
| 5,918,392 | A | 7/1999 | Bates | |
| 6,108,997 | A * | 8/2000 | Blais | E06B 3/9645 160/371 |
| 6,413,004 | B1 | 7/2002 | Lin | |
| 6,427,588 | B1 | 8/2002 | Kline | |
| D465,033 | S | 10/2002 | Messier | |
| D465,522 | S | 11/2002 | Beno | |
| 6,546,660 | B2 | 4/2003 | Roy | |
| D530,193 | S | 10/2006 | Goldenberg | |
| 7,677,003 | B2 | 3/2010 | Baughn | |
| 7,806,620 | B1 | 10/2010 | Brochez | |
| 8,028,489 | B1 | 10/2011 | Lawrence | |
| 8,250,819 | B2 | 8/2012 | Subra | |
| 8,763,342 | B2 * | 7/2014 | Tseng | E06B 3/9645 52/656.9 |
| D731,298 | S | 6/2015 | Therroen | |
| D736,065 | S | 8/2015 | Castellano | |
| D744,667 | S | 12/2015 | MacDonald | |
| D761,641 | S | 7/2016 | Pace | |
| 9,869,122 | B2 * | 1/2018 | Isaacs | E06B 1/32 |
| 9,879,472 | B2 * | 1/2018 | Isaacs | E06B 3/9682 |
| D822,471 | S | 7/2018 | MacDonald | |
| D832,679 | S | 11/2018 | MacDonald | |
| 10,174,544 | B2 * | 1/2019 | Kellum | E06B 3/9646 |
| 10,619,405 | B2 * | 4/2020 | Leontaridis | E06B 3/982 |
| D909,855 | S | 2/2021 | Kellum | |
| 2002/0005261 | A1 | 1/2002 | Therrien | |
| 2003/0000169 | A1 | 1/2003 | Davidsaver | |
| 2005/0193680 | A1 | 9/2005 | Wang | |
| 2006/0157208 | A1 | 7/2006 | Annacchino | |
| 2006/0207182 | A1 * | 9/2006 | Van Parys | E05D 15/5208 49/192 |
| 2007/0056701 | A1 | 3/2007 | Brooker | |
| 2008/0056817 | A1 | 3/2008 | Fasanella | |
| 2008/0216440 | A1 | 9/2008 | Kobayashi | |
| 2008/0219759 | A1 | 9/2008 | Therrien | |
| 2009/0282772 | A1 | 11/2009 | McGlinchy | |
| 2010/0192508 | A1 | 8/2010 | Subra | |
| 2011/0194886 | A1 | 8/2011 | Wu | |
| 2013/0019558 | A1 | 1/2013 | Tseng | |
| 2013/0064600 | A1 | 3/2013 | Tseng | |
| 2013/0272777 | A1 | 10/2013 | Hayter | |
| 2014/0318049 | A1 | 10/2014 | Paquet | |
| 2015/0121788 | A1 | 5/2015 | Kim | |
| 2016/0265268 | A1 | 9/2016 | Therrien | |
| 2017/0218680 | A1 | 8/2017 | Isaacs | |
| 2018/0347262 | A1 | 12/2018 | Kellum | |
| 2019/0178025 | A1 | 6/2019 | Kellum | |

FOREIGN PATENT DOCUMENTS

| | | | | |
|---|---|---|---|---|
| CN | 109681094 | A * | 4/2019 | |
| DE | 202006003782 | U1 * | 7/2007 | E06B 3/9681 |
| DE | 102011120374 | A1 * | 6/2013 | E06B 3/9682 |
| EP | 2479373 | A2 * | 7/2012 | E06B 3/9725 |
| FR | 2727167 | A1 * | 5/1996 | E06B 3/9682 |
| FR | 3012839 | A1 * | 5/2015 | E06B 3/9682 |
| JP | 06240958 | A | 8/1994 | |

OTHER PUBLICATIONS

Strybuc replacement corner keys, pp. 250-253: located online at: http://www.strybuc.com/public/Catalogs/Strybuc/Strybuc-Window-and-Door-Hardware-Catalog-2016/#?page=250, 2016.

* cited by examiner

CORNER KEY FOR EXTRUDED WINDOWS AND DOORS

CROSS-REFERENCE TO RELATED APPLICATIONS

This application claims priority to and the benefit of U.S. Provisional Patent Application No. 62/845,660, filed May 9, 2019, the disclosure of which is hereby incorporated by reference herein in its entirety.

INTRODUCTION

Window and door frames may be held together at a corner joint by an "L"-shaped piece of hardware known as a corner key. Corner keys enable two side members of the frame to be secured together without the hardware being substantially visible. These corner keys are press fit into the frame members to induce a retention force therein and restrict the corner key from being pulled out, which can cause the frame members to separate. However, some known corner keys do not provide a consistent retention force to restrain movement of the frame members. Additionally, some known corner keys may create a gap between two frame members because the corner keys become skewed within the frame members.

SUMMARY

In one aspect, the technology relates to a corner key including: a heel; at least one leg extending from the heel and defining a longitudinal axis; a nose disposed along the longitudinal axis, wherein the nose includes a first wedge area and an opposite second wedge area; and a bridge connecting the nose to the at least one leg, wherein upon insertion into a frame member, the nose substantially rotates to engage both the first wedge area and the second wedge area within the frame member and wedge the nose therein.

In an example, at least one of the first wedge area and the second wedge area is curved and defined by a radius. In another example, the first wedge area is defined by a first radius and the second wedge area is defined by a second radius, and the first radius is different than the second radius. In yet another example, the first radius is greater than the second radius. In still another example, the first wedge area and the second wedge area are offset along the longitudinal axis. In an example, a width of the nose between the first wedge area and the second wedge area substantially orthogonal to the longitudinal axis is greater than a width of the at least one leg.

In another example, prior to insertion into the frame, the first wedge area is at a first distance from the longitudinal axis and the second wedge area is at a second distance from the longitudinal axis, and the first distance is different than the second distance. In yet another example, the bridge is offset from the longitudinal axis. In still another example, the bridge is at least partially defined by a radius. In an example, upon rotation of the nose, the bridge acts as a spring element acting against a rotation direction of the nose. In another example, the bridge includes a lifting cam, and upon insertion into the frame member, the lifting cam at least partially induces rotation into the nose.

In yet another example, the at least one leg further includes a flange extending along the longitudinal axis. In still another example, the at least one leg further includes a cylindrical pivot post extending along the longitudinal axis. In an example, the corner key is formed from zinc zamak #3. In another example, the at least one leg is a first leg and the nose is a first nose, and the corner key further includes a second leg extending from the heel and having a second nose. In yet another example, the corner key further includes an inner surface and an opposite outer surface, and an undercut corner is defined in the inner surface at the intersection of the first leg and the second leg.

In another aspect, the technology relates to a corner key includes: a heel; at least one leg extending from the heel and defining a longitudinal axis; and a locking device extending from the at least one leg and configured to secure the corner key within a frame member, wherein the locking device includes a substantially pentagon shaped wedge have two opposing engagement surfaces, and wherein upon insertion into the frame member, the locking device substantially rotates such that a top engagement surface moves toward the heel and a bottom engagement surface moves away from the heel to engage both of the two engagement surfaces within the frame member and wedge the locking device therein.

In an example, the locking device further includes a spring element supporting the wedge, and upon rotation of the wedge, the spring element acts against a rotation direction of the wedge.

In another aspect, the technology relates to a method of engaging a corner key within a frame member, the method including: inserting a nose of the corner key into a channel of the frame member, wherein the nose includes two opposing engagement areas and extends from a leg of the corner key; sliding the leg into the channel such that the nose is fully received within the channel and both of the two opposing engagement areas are at least partially positioned against the channel; substantially simultaneously with sliding the leg into the channel, rotating the nose within the channel; and inducing movement between the corner key and the frame member so as to counter rotate the nose within the channel.

In an example, the method further includes deforming at least a portion of the frame member when the nose is engaged within the channel.

DRAWINGS

There are shown in the drawings, embodiments which are presently preferred, it being understood, however, that the technology is not limited to the precise arrangements and instrumentalities shown.

DETAILED DESCRIPTION

Figure 1:
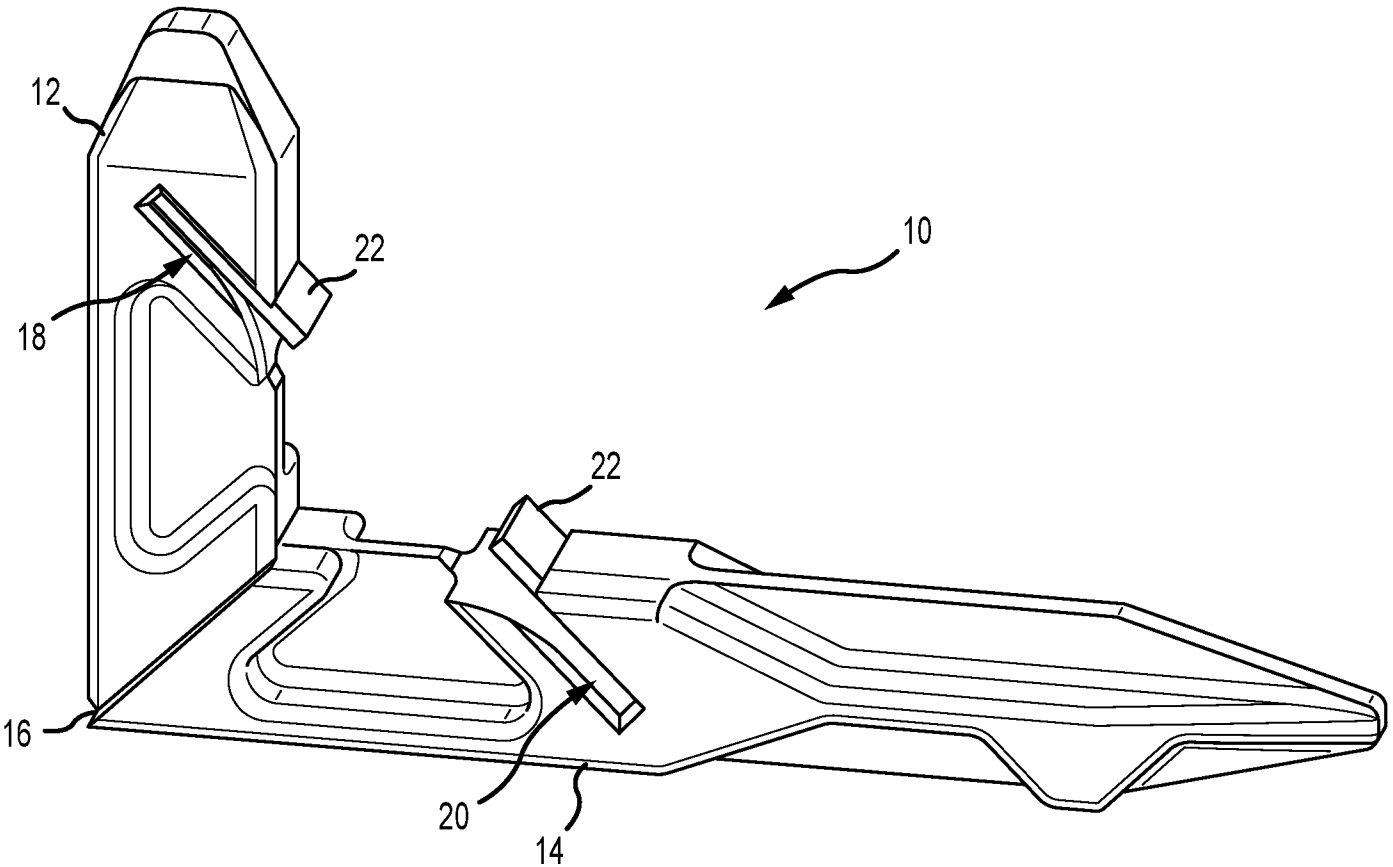
FIG.1 PRIOR ART
FIG. 1 is a perspective view of a prior art corner key.

FIG. 1 is a perspective view of a prior art corner key 10. The corner key 10 is a die cast "L"-shape with a short leg 12 and a long leg 14 connected at a heel 16. Each leg 12, 14 defines a slot 18, 20, respectively, that receives a steel tab 22 which is inserted therein. The steel tabs 22 are angled so as to act as retention devices when installed at a corner joint of an extruded window or door frame. However, when the corner key 10 is installed within the extruded frame, in order for the tabs 22 to fully engage with the frame and generate the retention force (e.g., the force required to pull the corner joint apart) that keeps the corner joint together, the corner key 10 must move relative to the frame members (e.g., pull at least partially out of the frame) a relatively large travel distance. This is because the tabs 22 are angled to allow for initial insertion into the frame, while providing engagement when moved in the opposite direction. The large travel distance is undesirable, because while the corner key 10 may eventually generate the required or desired retention force to keep the corner joint together, gaps may form between the frame members at the corner joints.

Figure 2:
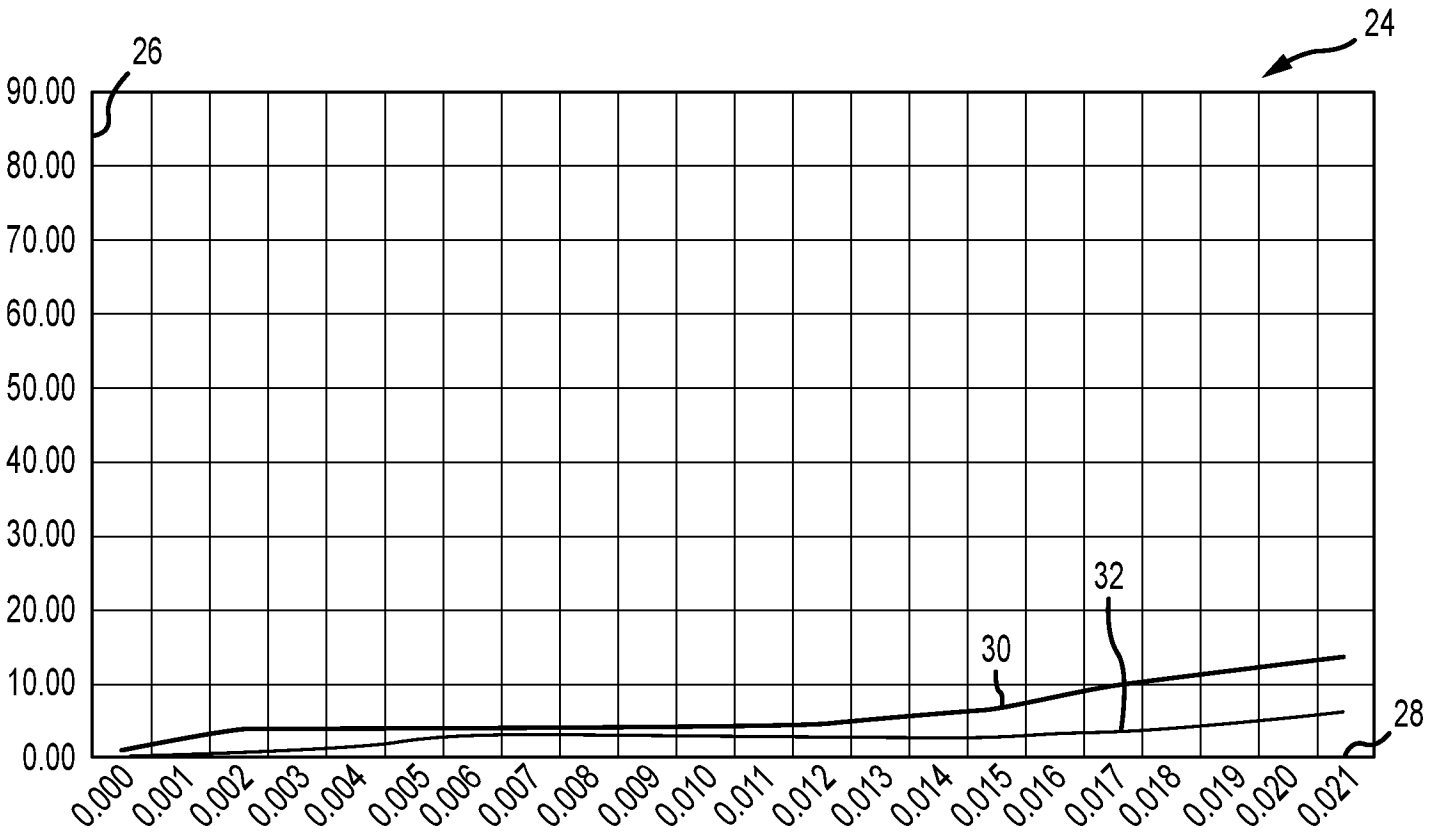
FIG.2 PRIOR ART
FIG. 2 is a graph that illustrates the relationship between a retention force and travel distance of the prior art corner key.

FIG. 2 is a graph 24 that illustrates the relationship between a retention force 26 and a travel distance 28 of the corner key 10 (shown in FIG. 1). The retention force 26 is plotted along the y-axis and is in units of pounds (lbs.) and the travel distance 28 is plotted along the x-axis and is in units of inches (in). As shown in FIG. 2, two separate corner keys 30 and 32 (similar to the corner key 10 described above) are measured for the retention force 26 (e.g., the engagement) with the extruded frame member and the travel distance 28 between the corner key and the frame member. When first inserted within the frame, the corner keys 30, 32 are partially engaged with the frame, but the retention force is low and the corner keys are not fully engaged with the frame. Generally, the corner keys are required or desired to generate at least about 20 lbs. of retention force 26 to be considered fully engaged with the frame. In the example, both corner keys 30 and 32 only start to generate about 10 lbs. of retention force 26 at around 0.02 inches of travel distance 28. This amount of movement, however, forms undesirable gaps between the frame members at the corner joints.

Additionally and with reference now to FIGS. 1 and 2, the slots 18, 20 of the corner key 10 are relatively thin, and as such, the die cast molds used for manufacturing the corner key 10 are fragile and are known to break. The manufacturing process for the corner key 10 further requires the separate steel tabs 22 to be inserted either manually, which is a laborious and time consuming process, or automatically, requiring a machine that must be frequently maintained. Additionally, the steel tabs 22 may undesirably shift out of position or fall out prior to use of the corner key 10. As such, the prior art corner key 10 is difficult to manufacture and provides inconsistent retention forces due to the manufacturing process. This is illustrated in the graph 24 and the large retention force differences between two similar corner keys 30, 32.

Broadly speaking, this disclosure describes configurations that improve the performance of a corner key. Specifically, examples, configurations, and arrangements of a corner key are shown and described in more detail below with reference to the following figures. The corner keys for extruded windows and doors described herein increases efficiency of installing the corner key and the retaining force generated by the corner key. The corner key includes a locking device formed by a nose supported by a bridge. The nose automatically rotates after insertion into the frame member, thereby at least partially engaging the frame member. Additionally, the nose is sized and shaped to enable the locking device to slide within the frame member during installation. Once the nose is installed within the frame member, a small amount of relative movement between the corner key and the frame member (e.g., travel) is required for the nose to at least partially counter rotate and fully engage with the frame member, thereby generating high retention forces. This engagement configuration increases retention forces of the connection (e.g., by restricting the corner key from pulling out of the frame member), and also reduces the movement of the frame member relative to the corner key so that undesirable gaps in the corner joint are reduced and/or prevented.

Figure 3:
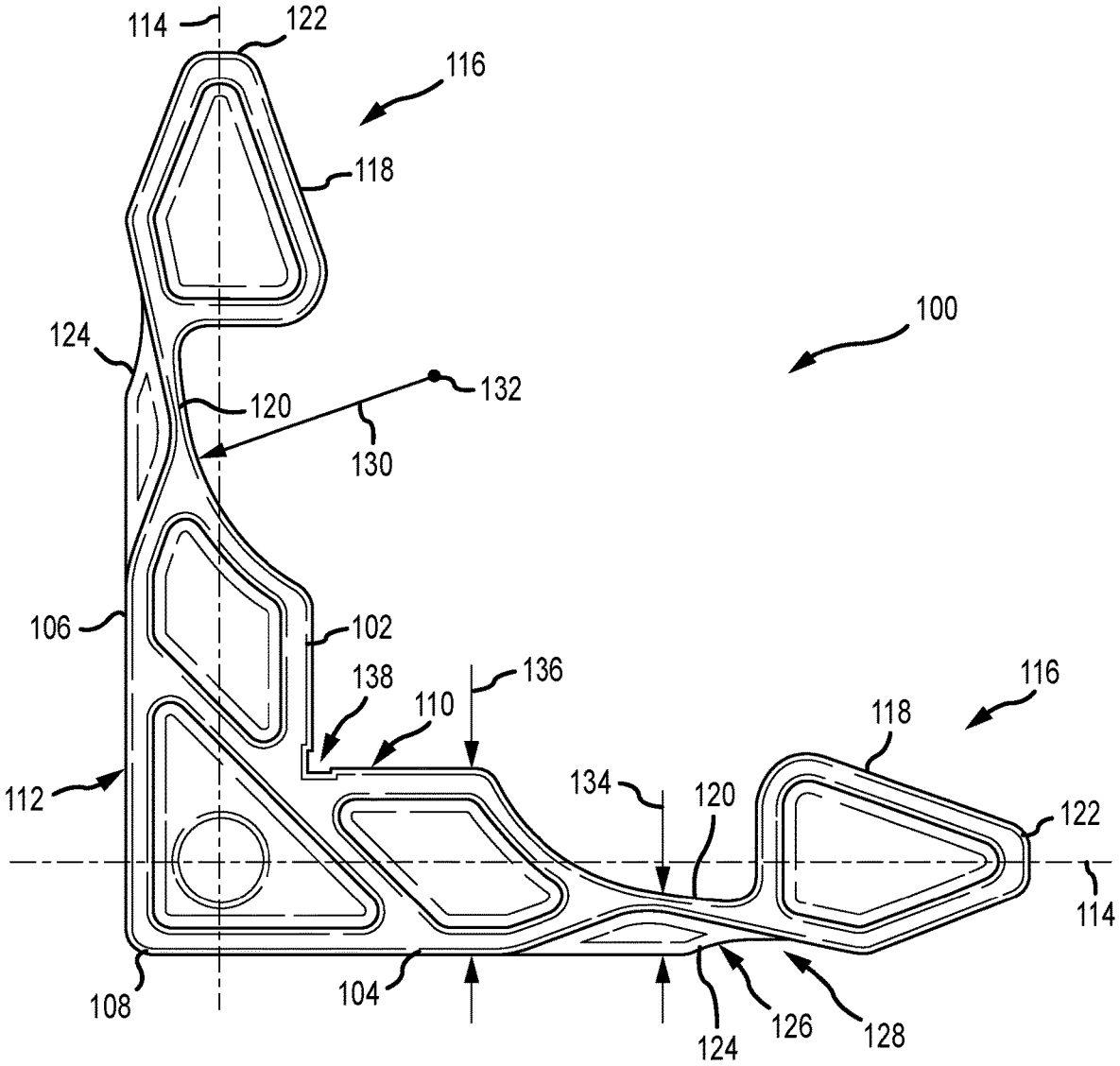
FIG. 3 is a side view of an exemplary corner key.

FIG. 3 is a side view of an exemplary corner key 100. In the example, the corner key 100 includes an "L"-shaped body 102 that includes a first leg 104 spaced approximately 90° from a second leg 106 and intersecting at a heel 108. The body 102 also includes an inner surface 110 and an opposite outer surface 112. As described herein, "inner" and "outer" refer to the orientation of the corner key 100 when being assembled in an extruded frame 200 of a window or door (shown in FIG. 5). Furthermore, orientations described as being above or at top of the corner key 100 are in a direction towards the inner surface 110, while orientations described as being below or at bottom of the corner key 100 are in a direction towards the outer surface 112. In the example, the axial length of the first leg 104 is approximately equal to the axial length of the second leg 106. Additionally, each leg 104, 106 has substantially similar features as described below.

Each leg 104, 106 extends along a longitudinal axis 114 with the inner surface 110 and the outer surface 112 be substantially equal distance from the longitudinal axis 114. A locking device 116 extends from each leg 104, 106 and is configured to secure the corner key 100 within an extruded frame member (not shown). The locking device 116 includes a nose 118 disposed along the longitudinal axis 114 and a bridge 120 connecting the nose 118 to the leg 104, 106. In operation, the nose 118 is configured to rotate within the extruded frame member to wedge the nose 118 therein and engage the nose 118 with the frame to generate retention forces and restrict the corner key 100 from being pulled out of the frame. The bridge 120 acts as s spring element during the rotation movement of the nose 118.

The nose 118 includes a tapered tip 122 that increases ease of insertion and enables the legs 104, 106 to be received more easily within the frame member. The bridge 120 includes a lifting cam 124 defined on the outer surface 112. The lifting cam 124 is offset along the longitudinal axis 114 from the nose 118 and includes an oblique surface 126 such that a notch 128 is formed on the outer surface 112. In operation, when the corner key 100 is inserted into the extruded frame member, the lifting cam 124 at least partially induces rotation R (shown in FIG. 5) into the nose 118. The bridge 120 is offset from the longitudinal axis 114 and in a direction towards the outer surface 112 of the corner key 100. The bridge 120 is at least partially defined by a first radius 130 having a first center point 132 that is opposite of the lifting cam 124 and offset from the inner surface 110 (both relative to the longitudinal axis 114). As such, the bridge 120 has a smaller first width 134 because of the radius 130 than a second width 136 of the legs 104, 106. The size and shape of the bridge 120 generates a spring force on the nose 118 during the rotation thereof. In some examples, the bridge 120 may have a first width 134 that is between about 20% and 45% of the second width 136 of the legs 104, 106. In another example, the bridge 120 may have a first width 134 that is about 33% of the second width 136 of the legs 104, 106.

In the example, the corner key 100 includes an "L"-shaped body 102 that may be formed from a one-piece zinc die casting method, such that the body 102 is unitary. In an aspect, the zinc material may be a zinc alloy such as zinc zamak #3. By using zinc alloys for manufacturing, the modulus of elasticity is such that the bridge 120 can generate a spring force for the nose 118 and provide enough elongation at yield to accommodate tolerances from the window extrusion and corner key manufacturing process. Additionally, once the yield strength of the zinc alloy is reached, the corner key 100 may permanently deform (e.g., within its plastic range), but it is sufficiently ductile so that further loading will not fracture the corner key 100 and the retention force within the extruded frame member is maintained. It should be appreciated, that the corner key may be formed from any other material that enables the function of the corner key as described herein.

At the intersection of the first leg 104 and the second leg 106, the heel 108 is defined and includes an undercut corner 138 defined in the inner surface 110. The undercut corner 138 reduces the depth of the heel 108 to enable an over-insertion of the corner key 100 within the extruded frame member and full engagement of the locking device 116. The undercut corner 138 also provides space within the corner key 100 to allow for varying manufacturing tolerances of the extruded members to fit closely together and form the corner joint.

Figure 4:
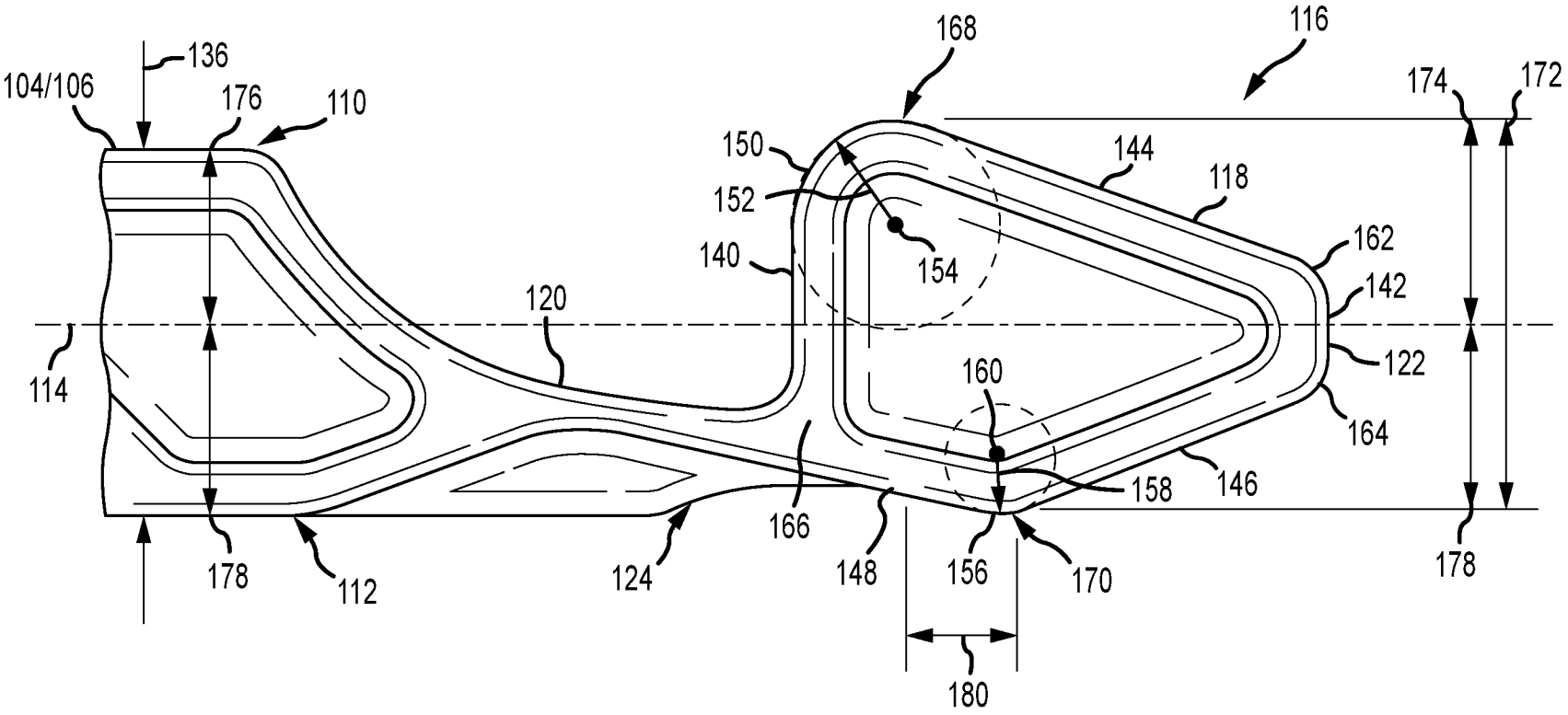
FIG. 4 is an enlarged view of a locking device of the corner key.

FIG. 4 is an enlarged view of the locking device 116 of the corner key 100 (shown in FIG. 3). As described above, each leg 104, 106 has the bridge 120 extending from the free end and that supports the nose 118. The leg 104, 106, the bridge 120, and the nose 118 are axially positioned along the longitudinal axis 114 that is centered about the second width 136 of the leg 104, 106. In the example, the nose 118 is a substantially pentagon shaped wedge having five sides and five corners. Additionally, the locking device 116 is illustrated in its uninstalled configuration.

A first side 140 of the nose 118 extends from the bridge 120 and is substantially orthogonal to the longitudinal axis 114. An opposite second side 142 is also substantially orthogonal to the longitudinal axis 114 and forms the tip 122. A third side 144 extends between the first side 140 and the second side 142 at the top of the nose 118 and extends in a downward direction to form the taper at the tip 122. A fourth side 146 is adjacent to the second side 142 at the bottom of the nose 118 and extends in an upward direction to form the taper at the tip 122. In some examples the third side 144 and the fourth side 146 may be orientated at substantially similar angles relative to the longitudinal axis 114. In other example, the third side 144 and the fourth side 146 may be orientated at different angles. A fifth side 148 is adjacent to the bridge 120 at the bottom of the nose 118.

A first corner 150 of the nose 118 extends between the first side 140 and the third side 144 and is positioned towards the top of the nose 118. The first corner 150 is curved and defined by a second radius 152 and a second center point 154 that is located within the nose 118 and above the longitudinal axis. A second corner 156 extends between the fourth side 146 and the fifth side 148 and is positioned towards the bottom of the nose 118. The second corner 156 is curved and defined by a third radius 158 and a third center point 160 that is located within the nose 118 and below the longitudinal axis 114. A third corner 162 extends between the third side 144 and the second side 142, while a fourth corner 164 extends between the second side 142 and the fourth side 146. The third corner 162 and the fourth corner 164 may be rounded and form a portion of the tip 122. A fifth corner 166 is between the first side 140 and the fifth side 148 and is integral with the bridge 120.

In operation, the first corner 150 at least partially defines a first wedge area 168 and the second corner 156 at least partially defines an opposite second wedge area 170. The wedge areas 168, 170 are curved surfaces that are configured to engage within the extruded frame member 200 (shown in FIG. 5) and secure the corner key therein. This wedge-like engagement of the nose 118 generates a retention force to form a corner joint in an extruded frame member. In the example, a third width 172 of the nose 118, as defined as the substantially orthogonal distance relative to the longitudinal axis 114 between the first wedge area 168 and the second wedge area 170, is greater than the second width 136 of the legs 104, 106. This third width 172 of the nose 118 is also greater than a width 208 the extruded frame member (shown in FIG. 5) that it is inserted within. As such, the nose 118 rotates R (shown in FIG. 5) in a counter-clockwise direction (e.g., the first wedge area 168 moving back towards the bridge 120 and the second wedge area 170 moving away from the bridge 120) relative to the tip 122 and when inserted into the extruded frame member. In some examples, the third width may be about 105% to 115% of the second width 136. Additionally, upon rotation of the nose 118, the bridge 120 acts a spring element to urge the first wedge area 168 and the second wedge area 170 (e.g., restrict the rotation of the nose 118) into the extracted frame and engage therewith.

The first wedge area 168 is offset a first distance 174 from the longitudinal axis 114 and towards the top of the corner key. This first distance 174 is greater than a second offset distance 176 that the inner surface 110 of the legs 104, 106 are from the longitudinal axis 114 and towards the top of the corner key. This width difference at least partially induces the rotation of the nose 118 within the extruded frame member and generates the retention force. In some examples, the first distance 174 may be about 102% to 108% of the second distance 176. The second wedge area 170 is substantially aligned with the outer surface 112 of the legs 104, 106 and both are offset a third distance 178 from the longitudinal axis 114 towards the bottom of the corner key. In the example, the third distance 178 is substantially equal to the second distance 176.

The first wedge area 168 is also defined by the second radius 152, while the second wedge area 170 is defined by the third radius 158. In the example, the second radius 152 is greater than the third radius 158. In one aspect, the second radius 152 may be about double the third radius 158. The second radius 152 also defines a diameter of the corner 150 and can be greater than the first distance 174. The second center point 154 is offset 180 along the longitudinal axis 114 from the third center point 160. As such and as illustrated in FIG. 4, from left to right, the nose 118 includes the first side 140 that is offset from the first wedge area 168, and the first wedge area 168 is offset from the second wedge area 170. In the example, the offset 180 may be substantially equal to the second radius 152 so that the second wedge area 170 is spaced from the first side 140 along the longitudinal axis 114 about the diameter of the corner 150. Also illustrated in FIG. 4, is the lifting cam 124 that is defined on the bridge 120.

The lifting cam 124 is offset from the first side 140 along the longitudinal axis 114 and towards the leg 104, 106.

Figure 5:
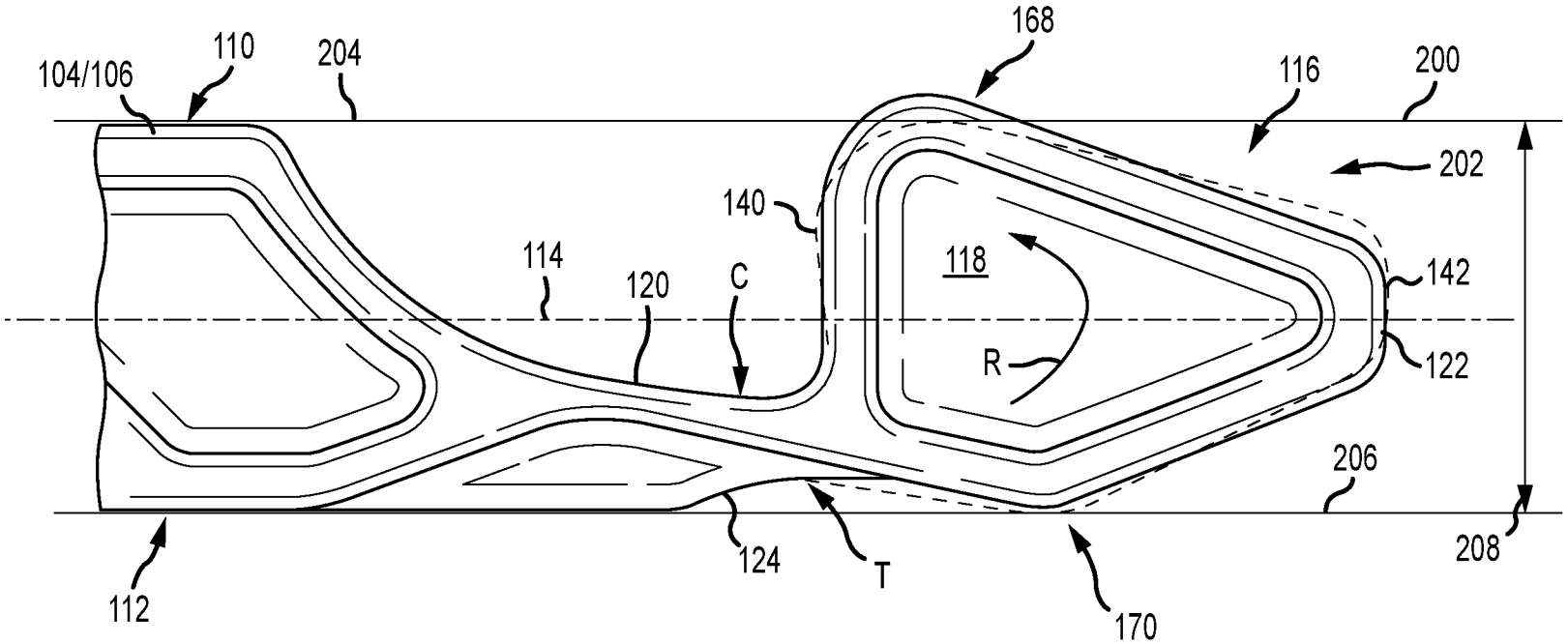
FIG. 5 is a schematic view of the locking device engaged within an extruded frame member.

FIG. 5 is a schematic view of the locking device 116 engaged within an extruded frame member 200. The engaged and rotated configuration of the locking device 116 is illustrated in broken lines. The extruded frame member 200 includes a channel 202 with an inner surface 204 and an opposite outer surface 206. In operation, as the leg 104, 106 of the corner key is inserted into the channel 202, the tapered tip 122 facilitates aligning the leg 104, 106 within the channel 202 so that it may be slidably received therein. The inner surface 110 of the leg 104, 106 slides against the inner surface 204 of the channel 202 and the outer surface 112 of the leg 104, 106 slides against the outer surface 206 of the channel 202. In the example, the frame member 200 is schematically illustrated in cross-section and can be either part of the window frame of a door frame. The corner key is configured to couple the frame member 200 to another frame member (not shown) so as to secure the two frame members together at a corner joint.

When the nose 118 is inserted within the channel 202, the first wedge area 168 is positioned against the inner surface 204 of the channel 202 and the second wedge area 170 is positioned against the outer surface 206 of the channel 202. Since the width 172 of the nose 118 is greater than a width 208 of the channel 202, counter-clockwise rotation R is induced into the locking device 116 to initially engage the frame member 200. In the example, the first wedge area 168 may rotate R towards the first side 140 of the nose 118, while the second wedge area 170 routes towards the tip 122 of the nose 118. In some examples, as the leg 104, 106 slides within the channel 202, the outer surface 206 of the channel 202 engages with the lifting cam 124 so that the leg 104, 106 aligns within the channel 202 and the longitudinal axis 114 is centered therein. This actuation may further force counter-clockwise rotation R into the locking device 116 to engage with the frame member 200. The lifting cam 124 is offset from the nose 118 so that the nose 118 is fully inserted within the channel 202 before the outer surface 206 engages with the lifting cam 124. Additionally, the first wedge area 168 and the second wedge area 170 are curved so as to enable the nose 118 to slide within the channel 202 and against the inner surface 204 and the outer surface 206 of the channel 202, respectively. This reduces the amount of force needed to insert the corner key within the frame member 200.

When the nose 118 is rotated and in the engaged and rotated configuration, the tip 122 of the nose 118 moves upward and towards the inner surface 204 of the channel 202. For example, a centerline of the tip 122 is offset from the longitudinal axis 114. This movement of the nose 118 also positions the first side 140 so that it is no longer orthogonal to the longitudinal axis 114. In some examples, the second side 142 is also no longer orthogonal to the longitudinal axis 114.

As the nose 118 is rotated R (as illustrated in the broken lines), compression stresses C are induced on the upper portion of the bridge 120 and tension stresses T are induced on the bottom portion of the bridge 120. These stresses allow the bridge 120 to act like a spring and urge the nose 118 to counter rotate back into its original orientation (e.g., a clockwise direction). For example, the compression and tension stresses induced by the rotation R of the nose 118 act in a direction that is against the rotation direction of the nose 118 (e.g., an opposing direction) to push the first wedge area 168 and the second wedge area 170 further into a frictional engagement with the frame member 200. The material properties of the corner key allow this movement of the nose 118 to occur without the stresses fracturing the bridge 120. Without the bridge 120, the nose 118 may rotate without frictionally engaging with the frame member 200.

Upon rotation R of the nose 118, the first wedge area 168 and the second wedge area 170 are at least partially engaged within the channel 202, but generate a relatively low retention force (e.g., less than 20 lbs.) because the locking device 116 is not fully engaged within the channel 202. However, this lower retention force is still sufficient to retain the corner key within the frame member 200. As described above, to fully engage the corner key within the frame member 200, the corner key must first be at least partially pulled out of the channel 202. However, because the third width 172 (shown in FIG. 3) between the first wedge area 168 and the second wedge area 170 is greater than a width 208 of the channel 202, the partial engagement of the locking device 116 is still greater than the prior art corner key 10 (shown in FIGS. 1 and 2).

Once the leg 104, 106 is within the channel 202, to fully engage the nose 118 within the channel 202 (e.g., wedged) and generate at least 20 lbs. of retention force to secure the corner key to the frame member 200, the leg 104 must be pulled at least partially out of the channel 202. This pull out movement is referred to as travel distance. When the leg 104, 106 is subsequently at least partially pulled back out of the channel 202, the nose 118 is urged to rotate in an opposite clockwise direction (e.g., the second wedge area 170 moving towards the bridge 120 and the first wedge area 168 moving towards the tip 122) that further wedges the nose 118 within the channel 202 and increases the retention force of the corner key. Because the third width 172 between the first wedge area 168 and the second wedge area 170 is greater than a width 208 of the channel 202, this wedge like movement of the nose 118 can deform the channel 202 depending on the material strength of the frame member 200. The travel distance induced by the pull back of the corner key, however, is not large enough to allow the nose 118 to fully rotate back into its original configuration.

The travel distance needed to fully engage the nose 118 may be induced during use of the corner key within the frame member 200. As such, the locking device 116 during use becomes fully engaged with the frame member 200. In some examples, when the corner key has the undercut corner 138 (shown in FIG. 3), the leg 104, 106 can be over-inserted into the channel 202 to induce the travel distance and preload a greater retaining force on the locking device 116.

Figure 6:
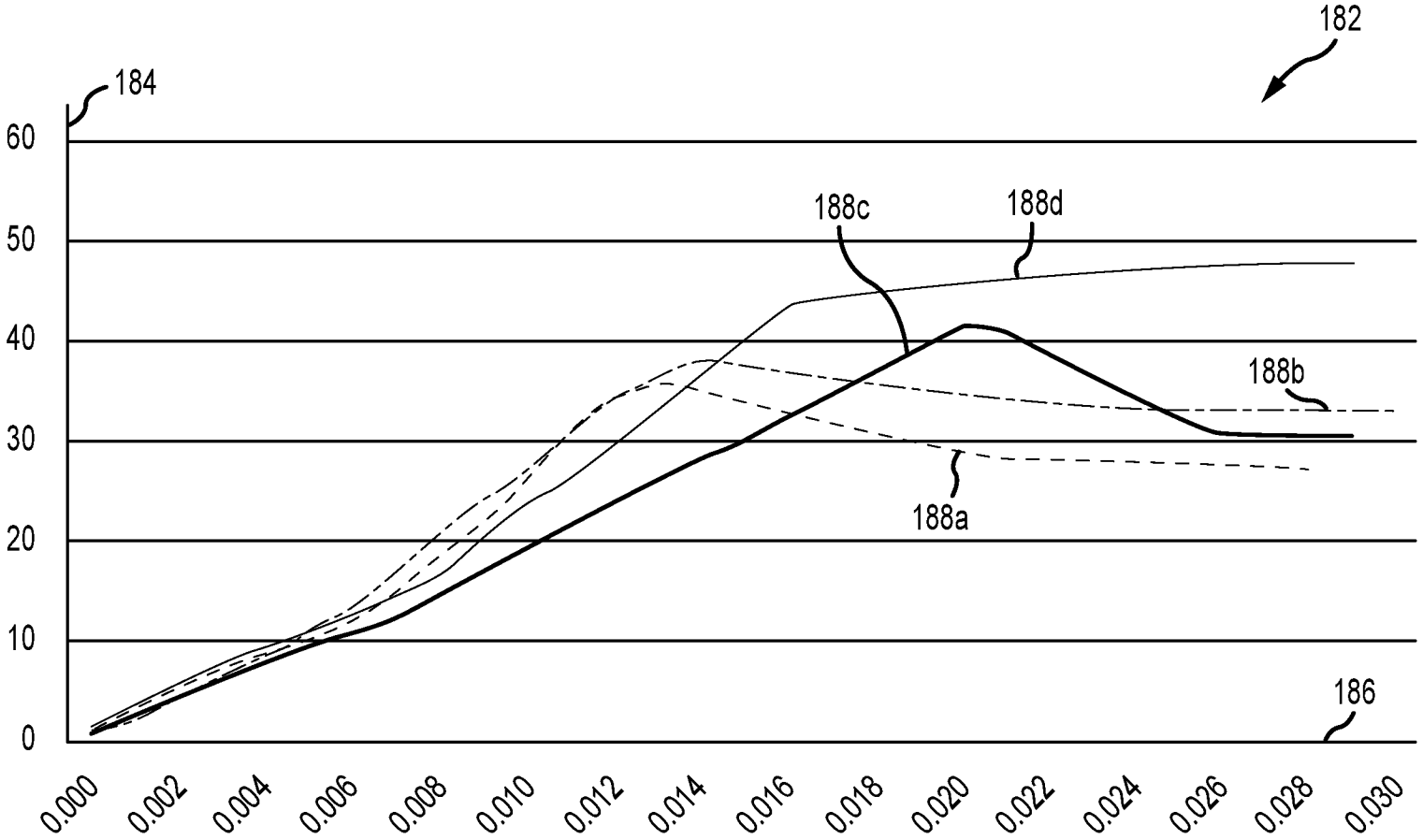
FIG. 6 is a graph that illustrates the relationship between a retention force and a travel distance of the corner key shown in FIGS. 3-5.

FIG. 6 is a graph 182 that illustrates the relationship between a retention force 184 and a travel distance 186 of the corner key 100 (shown in FIGS. 3-5). As described above in reference to FIG. 2, the prior art corner key has a travel distance of about 0.02 inches in order for the corner key to fully engage with the extruded frame member with a retention force of at least 20 lbs. This amount of travel between the corner key and the extruded frame member, however, forms undesirable gaps in the corner joint of the frame members. In the corner key described in FIGS. 3-5, the wedge-like engagement of the nose lowers the amount of travel distance 186 to fully engage with the extruded frame member with a retention force of at least 20 lbs. This smaller travel distance reduces or eliminates gaps forming in the corner joint of the frame members.

In the graph 182, the retention force 184 is plotted along the y-axis and is in units of pounds (lbs.) and the travel distance 186 is plotted along the x-axis and is in units of inches (in). As shown in FIG. 6, four separate corner keys 188 (that are similar to the corner key 100 described above) are measured for the retention force 184 (e.g., the engagement) with the extruded frame member and the travel distance 186 between the corner key and the frame member. When first inserted within the frame, the corner keys 188 are partially engaged with the frame, but the retention force is less than 20 lbs. and the corner keys are not fully engaged with the frame. However, this partial engagement generates greater retention forces than the prior art corner key. In the example, the corner keys 188 start to generate about 20 lbs. of retention force 184 at around 0.008-0.010 inches of travel distance 186. This amount of movement is less than the prior art corner key by about half. Additionally, the wedge-like engagement of the nose increases the total amount of retention force 184 that the connection can generate, thereby further reducing gaps being formed at the corner joint of the extruded frame members.

Additionally, because the locking device of the corner key is oversized when compared to the size of the channel of the extruded frame member, the corner key described herein can generate these increased retention forces no matter the manufacturing tolerances of the extruded frame members and the corner key. That is, due to manufacturing tolerances the exact dimensions extruded frame member and the corner key can vary by approximately 0.004 inches. However, since the locking device is oversized and engages with the frame member via rotation, these manufacturing tolerances do not affect the performance of the corner key.

Figure 7:
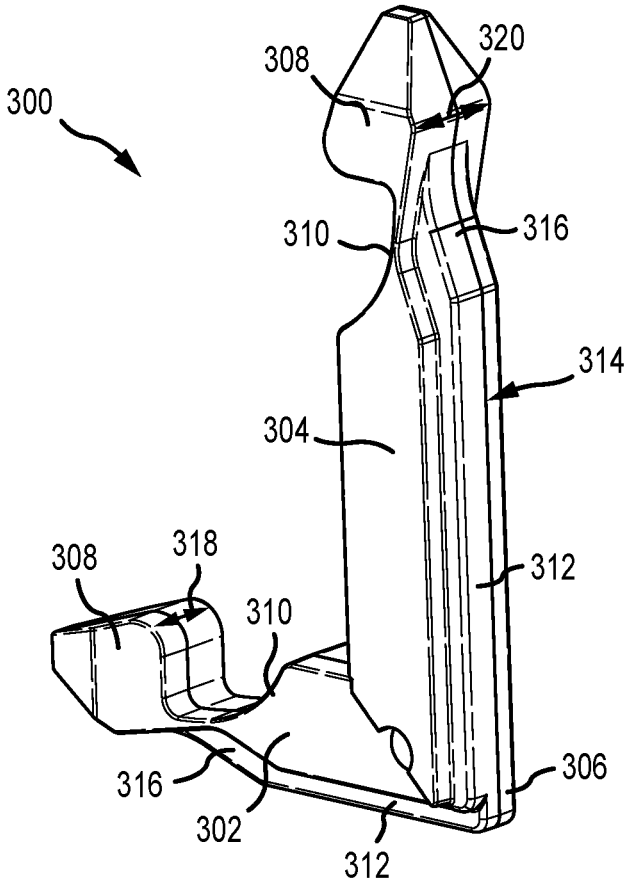
FIG. 7 is a perspective view of another example of a corner key.

FIG. 7 is a perspective view of another example of a corner key 300. The corner key 300 is similar to the example described above and includes a first leg 302 and a second leg 304 oriented approximately 90° from one another and extending from a heel 306. Each leg 302, 304 includes a nose 308 connected by a bridge 310. The nose 308 is configured to secure the corner key 300 within an extruded frame member and generate a retention force. In this example, the second leg 304 is axially longer than the first leg 302 so that additional window or door hardware may be located within the extruded frame member. In alternative examples, the first leg 302 may have a length that is approximately equal to a length of the second leg 304.

A flange 312 is included on an outer surface 314 of both of the legs 302, 304. The flange 312 extends outward from the outer surface 314 and substantially along the longitudinal axis of the legs 302, 304. The flange 312 corresponds to the shape and size of a corresponding channel of the extruded frame member and the channel is not substantially rectangular like the example described above. A lifting cam 316 may be at least partially defined in the flange 312 as required or desired. Additionally, a first thickness 318 of the first leg 302 is smaller than a second thickness 320 of the second leg 304 so as to correspond to different channel shapes and sizes of the extruded frame members.

Figure 8:
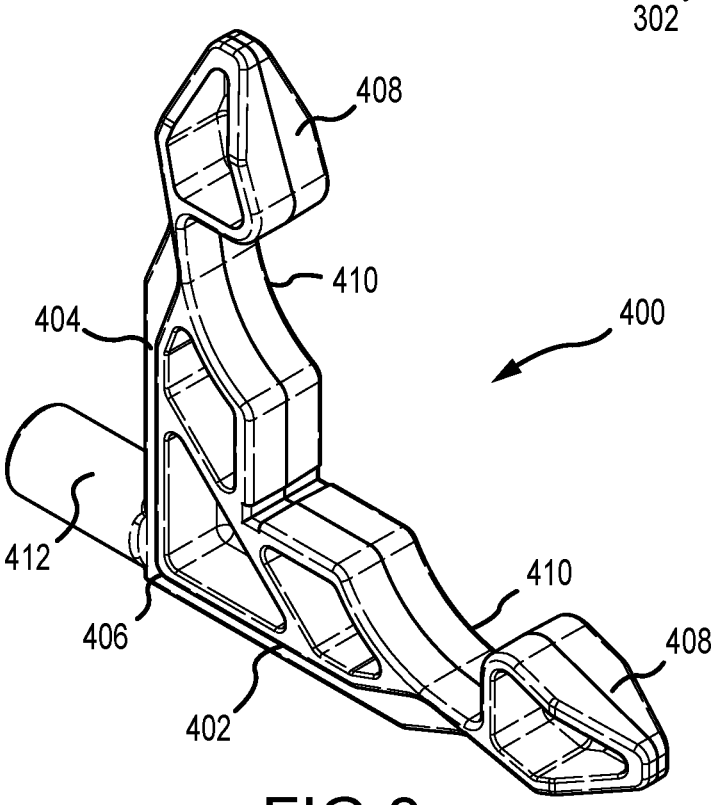
FIG. 8 is a perspective view of another example of a corner key.

FIG. 8 is a perspective view of another example of a corner key 400. The corner key 400 is similar to the examples described above and includes a first leg 402 and a second leg 404 oriented approximately 90° from one another and extending from a heel 406. Each leg 402, 404 includes a nose 408 connected by a bridge 410. The nose 408 is configured to secure the corner key 400 within an extruded frame member and generate a retention force. In this example, the corner key 400 includes a substantially cylindrical pivot post 412 extending from the heel 406 and along a longitudinal axis of one or both of the legs 402, 404. The pivot post 412 forms a pivot point for the extruded window or door frame to tilt about.

Figure 9:
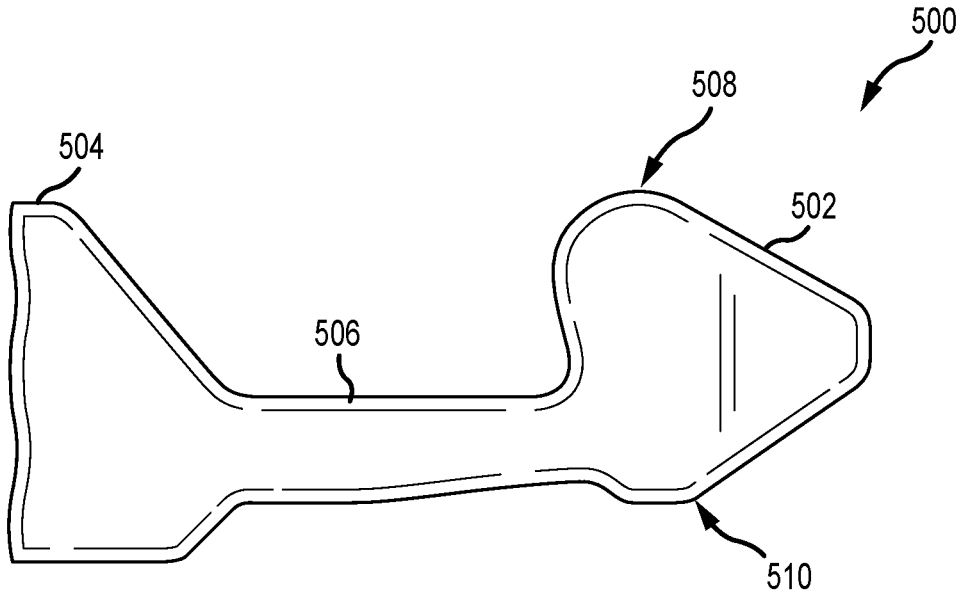
FIG. 9 is a side view of another example of a locking device.
Figure 10:
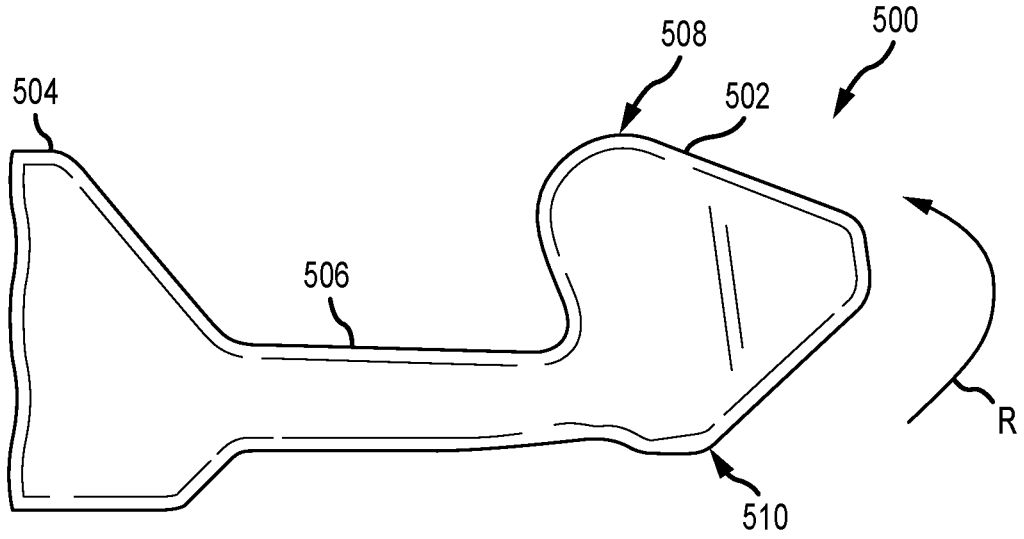
FIG. 10 is a side view of the locking device shown in FIG. 9 in an engaged configuration.

FIG. 9 is a side view of another example of a locking device 500. FIG. 10 is a side view of the locking device 500 in an engaged configuration. Referring concurrently to FIGS. 9 and 10, the locking device 500 can be used in any of the corner key examples described above. The locking device 500 includes a nose 502 coupled to a leg 504 by a bridge 506. Similar to the examples described above, the nose 502 includes a first wedge area 508 and an opposite second wedge area 510. The nose 502 when inserted within an extruded frame member rotates R (shown in FIG. 10) and generates a retention force to resist pullout of the corner key. Additionally, the nose 502 fully engages quickly (e.g., small travel distances) when the corner key is being pulled out. In this example however, the second wedge area 510 is formed with an angled corner and the bridge 506 extends linearly along the longitudinal axis defined by the leg 504.

Figure 11:
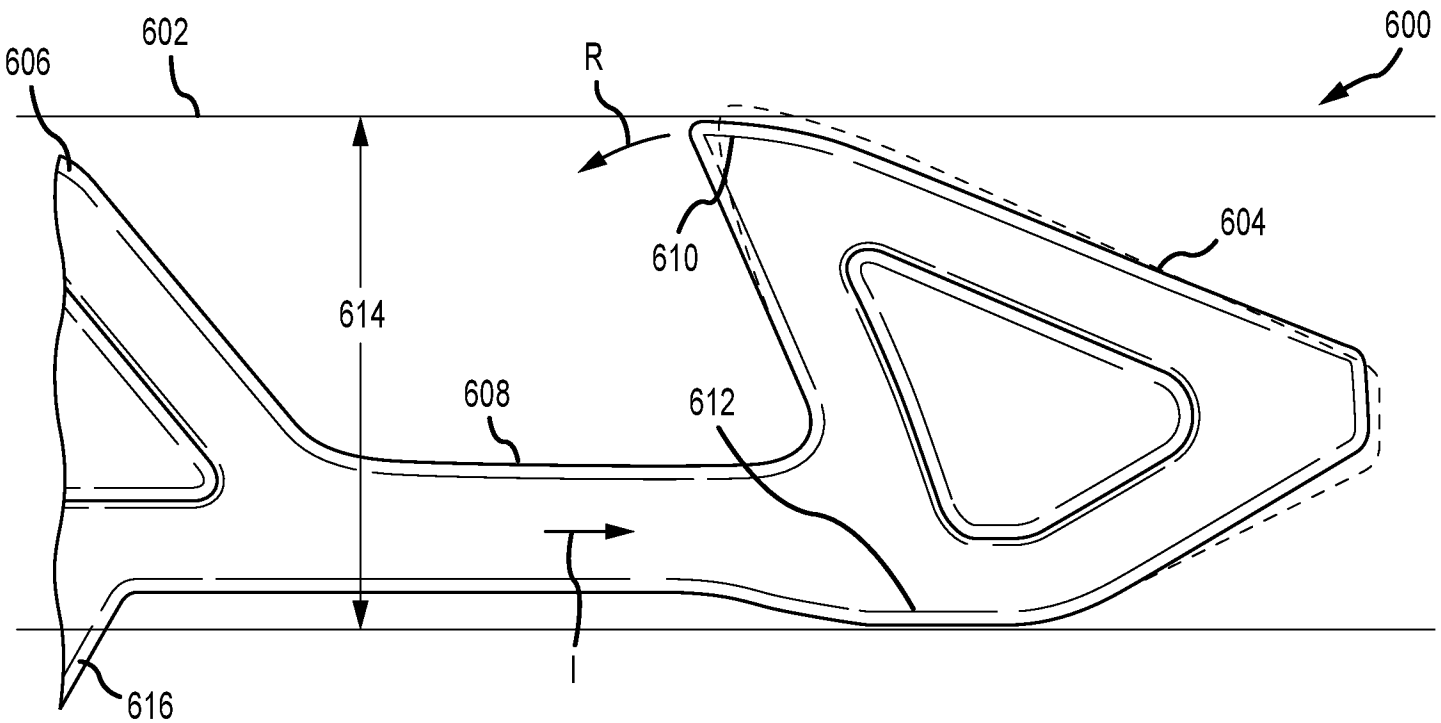
FIG. 11 is a schematic view of another example of a locking device engaged within an extruded frame member.

FIG. 11 is a schematic view of another example of a locking device 600 engaged within an extruded frame member 602. The original configuration of the locking device 600 is illustrated in broken lines. The locking device 600 can be used in any of the corner key examples described above. The locking device 600 includes a nose 604 coupled to a leg 606 by a bridge 608. Similar to the examples described above, the nose 604 includes a first wedge area 610 and an opposite second wedge area 612. The nose 604 when inserted I within the extruded frame member 602 rotates R and generates a retention force to resist pullout of the corner key. Additionally, the nose 604 fully engages quickly (e.g., small travel distances) when the corner key is being pulled out. In this example, however, the first wedge area 610 is formed with an angled corner. Furthermore, FIG. 11 illustrates that the width of the nose 604 in its original configuration is greater than a width 614 of the extrusion 602. A flange 616 is also illustrated and in this example extends at least partially out of the extrusion 602.

Figure 12:
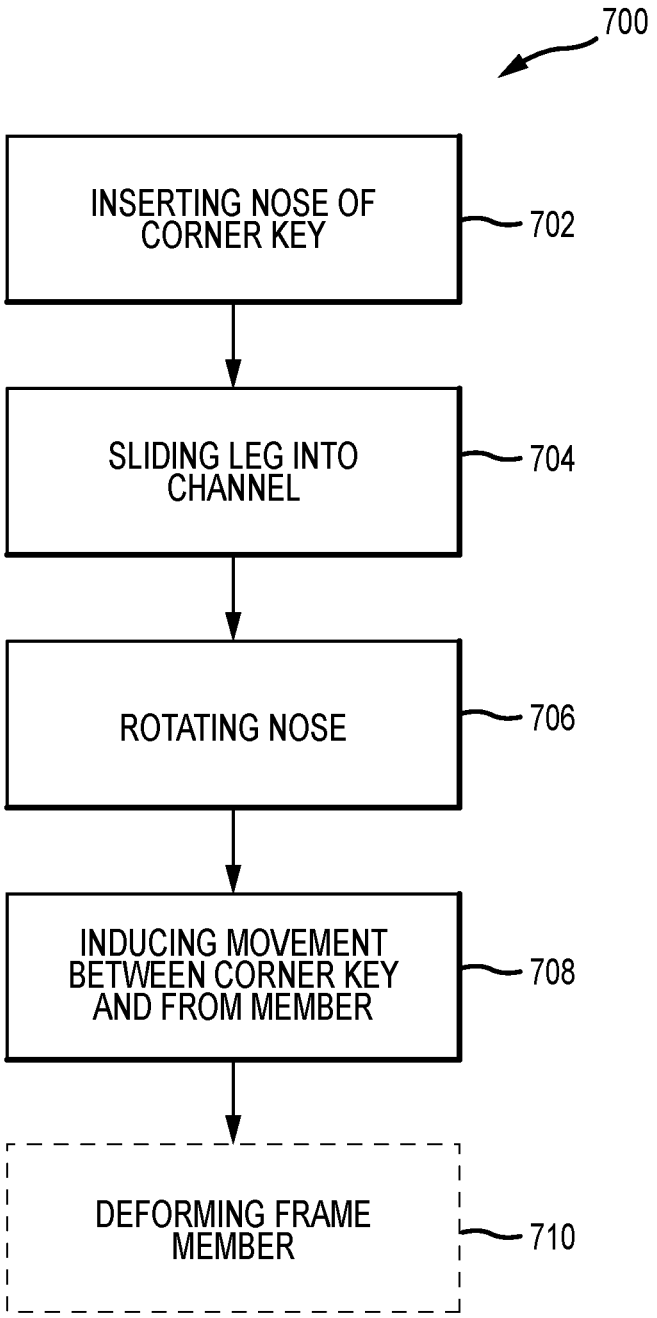
FIG. 12 is a flowchart illustrating a method of engaging a corner key within a frame member.

FIG. 12 is a flowchart illustrating a method 700 of engaging a corner key within a frame member. The method 700 includes inserting a nose of the corner key into a channel of the frame member (operation 702). The nose including two opposing engagement areas and extending from a leg of the corner key. Sliding the leg into the channel such that the nose is fully received within the channel (operation 704). When the nose is fully received within the channel (operation 704) both of the two engagement areas are at least partially positioned against the channel. Substantially simultaneously with sliding the leg into the channel (operation 704), the nose is rotated within the channel (operation 706). As the nose is rotated, a top engagement area moves towards the leg and a bottom engagement area moves away from the leg. The method 700 further including inducing movement between the corner key and the frame member so as to counter rotate the nose within the channel (operation 708). As the nose is counter rotated, the tope engagement area moves away from the leg and the bottom engagement area moves toward the leg. In some examples, at least a portion of the frame member may be deformed when the nose is engaged within the channel (operation 710).

The materials utilized in the corner keys described herein may be those typically utilized for window, window component manufacture, door, and door component manufacture. Material selection for the components may be based on the proposed use of the window or door. For example, the corner keys may be die-cast zinc. Aluminum, steel, stainless steel, plastic or composite materials can also be utilized. The window and door frame members may be extruded plastic, vinyl, or aluminum and contain other hardware therein.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A corner key comprising:

a body comprising:

an inner surface and an opposite outer surface;

a heel;

at least one leg extending from the heel and defining a longitudinal axis;

a nose disposed along the longitudinal axis, wherein the nose comprises a first wedge area disposed on the inner surface, an opposite second wedge area disposed on the outer surface, and a tip disposed at a distal end of the nose opposite the at least one leg, wherein the first wedge area and the second wedge area are offset along the longitudinal axis with the first wedge area being closer to the at least one leg than the second wedge area along the longitudinal axis, and wherein the longitudinal axis extends through the tip of the nose; and a bridge connecting the nose to the at least one leg, wherein the bridge is offset from the longitudinal axis and in a direction towards the outer surface of the at least one leg and the second wedge area, and wherein the at least one leg is configured to be inserted into a frame member such that upon insertion, the nose rotates to engage both the first wedge area and the second wedge area within the frame member and wedge the nose therein.

2. The corner key of claim 1, wherein at least one of the first wedge area and the second wedge area is curved and defined by a radius.

3. The corner key of claim 1, wherein the first wedge area is defined by a first radius and the second wedge area is defined by a second radius, and wherein the first radius is different than the second radius.

4. The corner key of claim 3, wherein the first radius is greater than the second radius.

5. The corner key of claim 1, wherein a width of the nose between the first wedge area and the second wedge area substantially orthogonal to the longitudinal axis is greater than a width of the at least one leg.

6. The corner key of claim 1, wherein prior to insertion into the frame, the first wedge area is at a first distance from the longitudinal axis and the second wedge area is at a second distance from the longitudinal axis, and wherein the first distance is different than the second distance.

7. The corner key of claim 1, wherein the bridge is at least partially defined by a radius.

8. The corner key of claim 1, wherein the bridge is configured to act as a spring element acting against a rotation direction of the nose when the at least one leg is inserted into the frame member.

9. The corner key of claim 1, wherein the bridge comprises a lifting cam, wherein the lifting cam is configured to at least partially induce rotation into the nose when the at least one leg is inserted into the frame member.

10. The corner key of claim 1, wherein the at least one leg further comprises a flange extending along the longitudinal axis.

11. The corner key of claim 1, further comprising a cylindrical pivot post extending from the heel along the longitudinal axis.

12. The corner key of claim 1, wherein the corner key is formed from zinc zamak #3.

13. The corner key of claim 1, wherein the at least one leg is a first leg and the nose is a first nose, the corner key further comprising a second leg extending from the heel and having a second nose.

14. The corner key of claim 13, wherein an undercut corner is defined in the inner surface at the intersection of the first leg and the second leg.

15. A corner key comprising:

a heel;

at least one leg extending from the heel and defining a longitudinal axis; and a locking device extending from the at least one leg and configured to secure the corner key within a frame member, wherein the locking device comprises a pentagon shaped wedge having a top engagement surface relative to the longitudinal axis, a bottom engagement surface relative to the longitudinal axis, and a tip surface extending orthogonal to the longitudinal axis and extending through the longitudinal axis, wherein the bottom engagement surface is closer to the tip surface than the top engagement surface along the longitudinal axis, and wherein the locking device is configured to rotate when inserted into the frame member such that the top engagement surface moves toward the heel and the bottom engagement surface moves away from the heel to engage both engagement surfaces within the frame member and wedge the locking device therein.

16. The corner key of claim 15, wherein the locking device further comprises a spring element supporting the wedge, and wherein spring element is configured to act against a rotation direction of the wedge when the locking device is inserted into the frame member.

17. A method of engaging a corner key within a frame member, the method comprising:

inserting a nose of the corner key into a channel of the frame member, wherein the nose includes two opposing engagement areas and extends from a leg of the corner key;

sliding the leg into the channel such that the nose is fully received within the channel and both of the two opposing engagement areas are at least partially positioned against the channel;

simultaneously with sliding the leg into the channel, rotating the nose within the channel; and inducing movement between the corner key and the frame member so as to counter rotate the nose within the channel; and deforming at least a portion of the frame member when the nose is engaged within the channel.

* * * * *